US012629585B2

(12) United States Patent
Jackson

(10) Patent No.: US 12,629,585 B2
(45) Date of Patent: May 19, 2026

(54) DICE SHAKING MECHANISM

(71) Applicant: TCS John Huxley Europe Limited, Stoke-On-Trent (GB)

(72) Inventor: Gavin Jackson, Stoke-On-Trent (GB)

(73) Assignee: TCS John Huxley Europe Limited, Stoke-On-Trent (GB)

( * ) Notice: Subject to any disclaimer, the term of this patent is extended or adjusted under 35 U.S.C. 154(b) by 812 days.

(21) Appl. No.: 17/641,388

(22) PCT Filed: Oct. 1, 2020

(86) PCT No.: PCT/GB2020/052403
§ 371 (c)(1),
(2) Date: Mar. 8, 2022

(87) PCT Pub. No.: WO2021/069867
PCT Pub. Date: Apr. 15, 2021

(65) Prior Publication Data

US 2022/0347553 A1 Nov. 3, 2022

(30) Foreign Application Priority Data

Oct. 11, 2019 (GB) ..... 1914772

(51) Int. Cl.
*A63F 9/04* (2006.01)
*A63F 9/24* (2006.01)

(52) U.S. Cl.
CPC .... *A63F 9/0406* (2013.01); *A63F 2009/2482* (2013.01)

(58) Field of Classification Search
CPC ..... A63F 9/0406; A63F 2009/2482
See application file for complete search history.

(56) References Cited

U.S. PATENT DOCUMENTS 1,353,380 A * 9/1920 Church ..... A63F 9/0406 273/145 D
1,766,134 A * 6/1930 Lauterbach ..... A63F 9/0406 273/145 D (Continued)

FOREIGN PATENT DOCUMENTS

| | | | |
|---|---|---|---|
| FR | 702672 | A1 | 4/1931 |
| GB | 827766 | A1 | 2/1960 |
| WO | 2006003366 | A1 | 1/2006 |

OTHER PUBLICATIONS

Office Action from counterpart Great Britain Application No. 1914772.7 dated Apr. 12, 2023, 2 pp.

(Continued)

*Primary Examiner* — Joseph B Baldori
*Assistant Examiner* — Christopher Glenn
(74) *Attorney, Agent, or Firm* — Shumaker & Sieffert, P.A.

(57) ABSTRACT

There is described an automated dice shaking mechanism for use for example in casinos. The dice shaking mechanism comprises a driving member; a drive shaft connected to the driving member and wherein the drive shaft is arranged in communication with a crank pin. The mechanism is operable such that the drive shaft is arranged to rotate about a drive shaft axis, the crank pin having a crank pin axis offset from the drive shaft axis; a control arm and a lifting member and wherein the control arm has a first end and an opposing second end. In the mechanism the first end is connected to the crank pin, the control arm is then arranged to move the lifting member along a vertical axis of the dice shaking mechanism. The lifting member comprises a frame attached to the second end of the control arm; and a platform attached to the frame, and in this way the platform movement provides the dice shaking and activation. The mechanism (Continued)

provides for improvements in reliability, repeatability and robustness of the casino gaming equipment.

16 Claims, 7 Drawing Sheets

(56) References Cited

U.S. PATENT DOCUMENTS

| | | | | |
|---|---|---|---|---|
| 2,462,686 | A | 2/1949 | Stallard | |
| 2,511,092 | A | 6/1950 | Ashleman | |
| 3,350,098 | A * | 10/1967 | Cromp | A63F 9/0406 200/600 |
| 6,575,834 | B1 | 6/2003 | Lindo | |
| 6,776,715 | B2 | 8/2004 | Price | |
| 2002/0147047 | A1 | 10/2002 | Letovsky et al. | |
| 2018/0085660 | A1 * | 3/2018 | Bergant | A63F 9/0406 |

OTHER PUBLICATIONS

Tcs John Huxley Europe Ltd, "Dice Shaker", TCS John Huxley, Retrieved from: https:/ /www.tcsjohnhuxley.com/products/dice-shaker, Accessed on: Mar. 27, 2020, Apr. 19, 2019, 10 pp.

Notice of Intent to Grant and Text Intended to Grant from counterpart European Application No. 20789222.5 dated Oct. 18, 2023, 30 pp.

International Search Report and Written Opinion of International Application No. PCT/GB2020/052403, dated Jan. 12, 2021, 9 pp.

Communication pursuant to Article 94(3) EPC from counterpart European Application No. 18800282.8 dated Mar. 2, 2022, p. 10.

International Preliminary Report on Patentability from International Application No. PCT/GB2020/052403, dated Apr. 21, 2022, 8 pp.

* cited by examiner

DICE SHAKING MECHANISM

FIELD OF THE INVENTION

The present invention relates to an automated dice shaking mechanism, and particularly to an automated dice shaking mechanism for use in casinos.

BACKGROUND TO THE INVENTION

In the casino industry there currently exist many games that rely on random number generation. There are several different methods of random number generation with many casino games involving the roll of one or more dice to generate the random numbers such as Craps or Sic Bo.

Many games that involve gambling utilise dice rolling, for example Sic Bo, an ancient game originating in China but with European variants that have near identical rules. The game involves a Sic Bo board, three dice, an operator (or dealer) and a number of players. Players place a bet on the outcome of the three dice, wherein the outcome is the combined total of the three dice after being rolled. The win condition involves the player's bet matching the outcome of the three dice. The integrity of the game relies on the ability of the outcome of the roll of the dice to be truly random.

An issue facing the aforementioned game is that whilst the dealer is capable of rolling the dice with a degree of randomness and at a relatively fast pace, there exists the possibility of an element of distrust between the player and the dealer. Furthermore, the dealer can only roll a finite number of dice at the same time which limits the number of games that can take place at a given moment. Another issue faced by games that utilise dice shaking mechanics is that the number of dice that can be shaken at the same time is limited to the space available to game in.

Automation is becoming increasingly prevalent in the casino gambling industry with many games replacing dealers with automated systems to improve efficiency and remove human error. Such automations include, for example, automatic roulette wheels in which the roulette wheel is spun via a mechanical system without the input of a person.

These mechanical systems allow for an increase in the frequency at which the games can be played, leading to an acceleration in the associated wear and tear which in turn reduces the longevity of the components. Furthermore, there is a possibility for mechanical error introduced wherein if a component is faulty, it could lead to a negative impact on the integrity of the game.

It is therefore desirable to provide devices that are both mechanically strong and robust as well as devices that do not necessarily require the intervention of an operator.

SUMMARY OF THE INVENTION

In accordance with the present invention, there is provided a dice shaking mechanism, the dice shaking mechanism comprising, a driving member; a drive shaft connected to the driving member, the drive shaft in communication with a crank pin. Preferably, the drive shaft is arranged to rotate about a drive shaft axis, the crank pin having a crank pin axis offset from the drive shaft axis. The dice shaking mechanism further comprises a control arm and a lifting member. The control arm has a first end and an opposing second end, the first end connected to the crank pin. The control arm is arranged to move the lifting member along a vertical axis of the dice shaking mechanism, wherein the lifting member comprises a frame attached to the second end of the control arm, and a platform attached to the frame.

The lifting member of the present invention is preferably, arranged to reciprocally move between a first position and a second position, each the first position and second position located on the vertical axis of the dice shaking mechanism. P Preferably, the location of the first position is vertically above the second position along the vertical axis of the dice shaking mechanism. Preferably, the distance between the first position and second position is directly related to the offset distance of the crankpin or completely equal to the offset distance of the crankpin. In addition, the first position and second position are also directly related to the initial position and the final position respectively. In the context of the present invention the terms "first position" and "second position" will be understood by the skilled addressee to be interchangeable.

Preferably, the dice shaking mechanism further comprises, a limiting mechanism. The limiting mechanism is preferably, arranged to restrict the movement of the platform and frame to the first position and the second position. Preferably, the limiting mechanism is arranged to limit the movement of the platform to movement between the first position and the second position. Preferably, the limiting mechanism is arranged such that the first position is located between 2 cm and 5 cm vertically above the second position, allowing for an adequate amplitude of oscillation to create the desired dice shaking characteristics. Preferably, in some embodiments, the limiting mechanism is connected to the frame. It should be noted that in further embodiments, the limiting mechanism may not be connected to the frame. Preferably, the limiting mechanism allows for the mitigation of a potential degree of damage that could originate from the vertical movement of the platform and the frame as, for example, the vertical movement of the platform and the frame could cause damage to the crankpin if allowed to oscillate freely.

Preferably, the platform is arranged to have upper platform surface aligned along an orthogonal plane in relation to the vertical axis of the dice shaking mechanism. In some preferred embodiments, the shape of the upper platform surface is a disc. Other embodiments are appreciated wherein the upper platform surface is any suitable shape with an upper platform width and an upper platform depth. The upper platform width is the distance between two diametrically opposite sides of the upper platform surface. Preferably, the upper platform depth is the distance along the vertical axis of the dice shaking mechanism that the upper platform occupies at any one time. It should be appreciated by the skilled addressee that the dimensions of the platform are scalable with a requirement being that the upper surface has a larger surface area than the number of dice multiplied by the effective area of the dice such that the number of dice are able to shake at the desired dice shaking characteristics. The dice shaking characteristics may comprise, for example, a displacement of the dice along the vertical axis from the upper platform surface at different points of the oscillation distance. Another example includes a rotational speed of the dice as they are displaced from the platform, the rotational speed of the dice describing the number of rotations during a period of time, the period of time being the time taken for the crankpin to complete one revolution. A further example includes a contact angle at which the dice makes contact with the platform at any point that the dice makes contact with the platform, the contact angle influencing the dice shaking characteristics previously mentioned.

Preferably, the dice shaking mechanism further comprises, a guiding mechanism arranged to restrict the motion of the frame and/or platform to along the vertical axis.

Preferably, the guiding mechanism is in the form of a rigid rod preferably, attached to the frame of the dice shaking mechanism. The purpose of the guiding mechanism is to minimise horizontal movement of the platform, the horizontal movement being undesired. In some embodiments, the frame of the dice shaking mechanism is preferably, attached slidably to the rigid rod such that the frame is able to move along the vertical axis. Preferably, the guiding mechanism allows for the mitigation of a potential degree of damage that could originate from the horizontal movement of the platform and the frame as, for example, the horizontal movement of the platform and the frame could cause unwanted strain on the crankpin due to the horizontal movement shearing the crankpin. It shall be appreciated by the skilled addressee that the guiding mechanism may comprise a number of different guiding mechanisms including, for example, guide rails.

The dice shaking mechanism preferably, further comprises, a sensor; and a corresponding sensor actuator. Preferably, the sensor actuator is arranged to stimulate the sensor. Preferably, the sensor is configured to transmit a signal after the stimulation occurs. The signal is then preferably, read by an external sensor CPU which in turn converts the signal into usable data, the external sensor CPU potentially being part of the microcontroller. An example of usable data includes, for example, measuring the distance between the sensor and sensor actuator.

Information gathered from the sensor and sensor actuator may be used to measure the number of oscillations, the number of oscillations being set to an oscillation count wherein the oscillation count is preferably, predetermined. In some embodiments, the oscillation count may preferably be randomly generated by an external CPU that could be part of the microcontroller. It should be appreciated by the skilled addressee that there could be several variations for the sensor including, for example, a proximity sensor, a capacitive sensor or magnetic sensor. Preferably, the sensor and corresponding sensor actuator potentially allows the mitigation of further damage by, for example, the external driving CPU detecting the platform and the frame approaching the first position or the second position and the external driving CPU reducing the rotation speed of driving member such that the platform and the frame slows down, thus reducing the potential impact damage.

The dice shaking mechanism further comprises, a housing wherein the housing is preferably arranged to comprise of an interior channel, the interior channel being an area within the housing and the housing exterior being an area of the housing that surrounds the interior channel. Preferably, the interior channel is arranged to accommodate the frame. Preferably, in embodiments comprising the interior channel, the interior channel accommodates the frame such that the frame is arranged to move freely along the vertical axis. Preferably, the interior channel is further arranged to accommodate the control arm wherein the control arm is attached to the frame at the second end, the control arm spanning parallel to the body of the frame along the vertical axis. Preferably, the interior channel is further arranged to accommodate the crank pin wherein the crank pin is attached to the control arm at the first end. The interior channel is further arranged to preferably, accommodate the cam wheel wherein the cam wheel is attached to the crankpin; the cam wheel being aligned along the vertical axis. The interior channel is also preferably, arranged to accommodate the drive shaft wherein the drive shaft is protruding from the cam wheel. Preferably, the interior channel is further arranged to accommodate the driving member wherein the driving member extends from the drive shaft perpendicular to the vertical axis. Preferably, in some embodiments, the interior channel is further arranged to accommodate the limiting mechanism such that the limiting mechanism spans along the frame along an axis perpendicular to the vertical axis. It should be appreciated that in other embodiments, the limiting mechanism does not have to be connected to the frame and/or be accommodated by the housing. Preferably, the housing exterior is configured to have a housing exterior thickness wherein the housing exterior thickness is the distance along the horizontal axis that the housing exterior is solid. Preferably, the housing exterior is arranged such that the platform sits atop the housing exterior, in some embodiments the platform being outside the interior channel.

In some embodiments, the dice shaking mechanism may further comprise a screen member, the screen member having an inner surface and an outer surface. Preferably, the screen member is positioned protruding from the housing. The screen member is preferably, protruding from the housing in a direction that follows vertically along the vertical axis wherein the screen member extends outwards from the plane of the upper platform surface. Preferably, the screen member is arranged such that the screen member forms a screen member cavity extending outwards from the upper platform surface wherein the screen member cavity is a cavity. Preferably, the screen member has a screen member thickness wherein the screen member thickness is the distance between points of the inner surface and outer surface of the screen member.

The screen member cavity is preferably shaped to fully encompass the platform, for example in some embodiments as a dome. It should be appreciated that in further embodiments, the screen member cavity is not necessarily dome shaped and may be cylindrical in shape. The dimensions of the screen member are preferably set such that the dimensions of the cavity include a cavity width and a cavity height wherein the cavity width is the distance between two diametrically opposite sides of the cavity along the same plane as the upper platform surface and the cavity length is the distance along the vertical axis spanned by the cavity. Preferably, the cavity width may be greater than the upper platform width. Preferably, the difference between the cavity width and the upper platform width is lower than the die side length such that the dice are unable to travel below the upper platform surface. Preferably, the cavity height is arranged such that the number of dice are able to exhibit the desired dice shaking characteristics wherein the cavity height allows for the displacement of the dice to be of adequate magnitude.

In some embodiments, the screen member has a screen member material. Preferably, the screen member material is such that, in some embodiments, the screen member is in a translucent state. In other preferred embodiments, the screen member material comprises an opaque material.

In some embodiments, the dice shaking mechanism may further comprise a damping component. The damping component opposes the motion of the platform during the oscillation. Preferably, the damping component opposes the motion of the platform between the first position and the second position. The damping component may oppose the direction of oscillation between the first position and the second position and/or the direction of oscillation between the second position and the first position. Preferably, the damping component opposes the motion of the platform as it approaches either the first position or the second position.

Preferably, the damping component is arranged such that the platform sits below the top of the cushion. This arrangement preferably stops the one or more dice making contact with the screen member.

In preferable embodiments, the damping component of the dice shaking mechanism may be a cushioning component. The cushioning component of the dice shaking mechanism may preferably, be positioned such that the platform is unable to make direct contact with the housing exterior. Such arrangements could avoid any unnecessary wear and tear that would be associated with the repetitive contact between the platform and the housing exterior. Preferably the cushioning component consists of, for example, rubber, foam or polymer. More examples of a damping component may include a spring, or a variable electromagnetic field at the poles of a step motor. Preferably, the damping component may provide a further reduction to the potential damage caused by the impact of the frame thus decreasing the wear and tear of the dice shaking mechanism over time.

It shall be appreciated by the skilled addressee that the previously mentioned embodiments are by way of example only. Additional embodiments exist wherein the present invention can be of any shape, size, material or could be part of a set containing more than one dice shaking mechanism.

DETAILED DESCRIPTION

Specific embodiments will now be described by way of example only, and with reference to the accompanying drawings, in which.

Figure 1A:
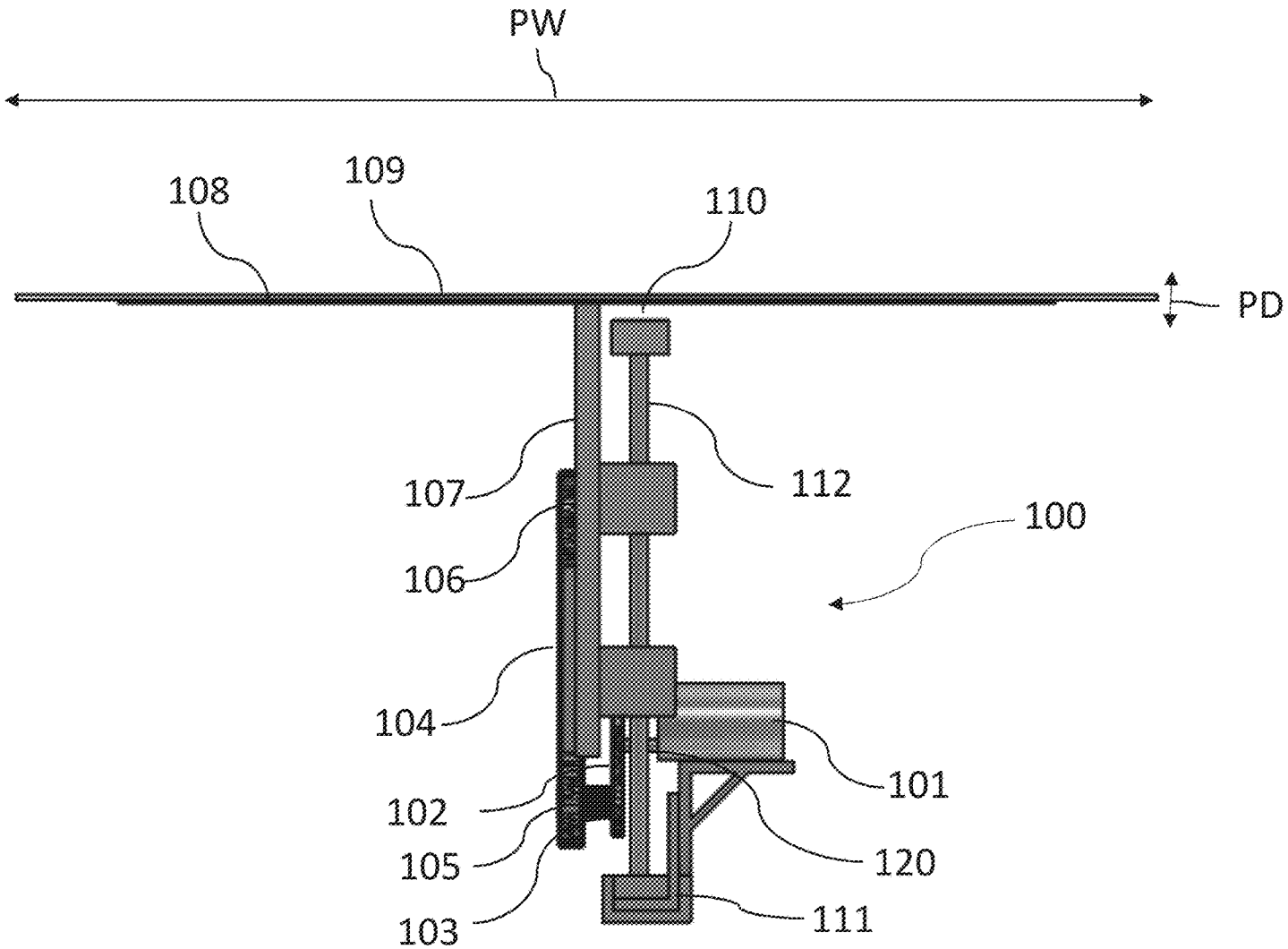
FIG. 1A shows a horizontal sectional view of the present invention shown without a housing.
Figure 1B:
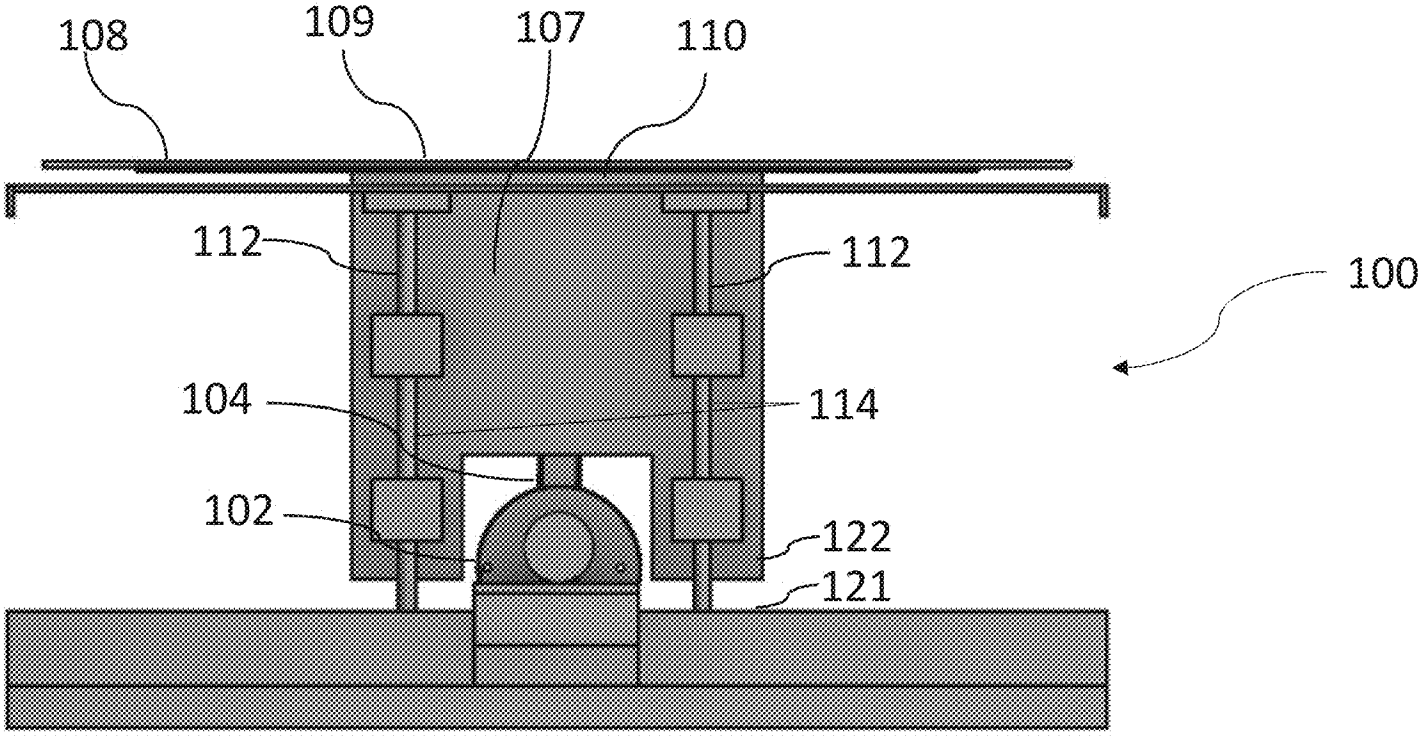
FIG. 1B shows a front sectional view of the present invention of FIG. 1A with a 90 degree rotation.
Figure 1C:
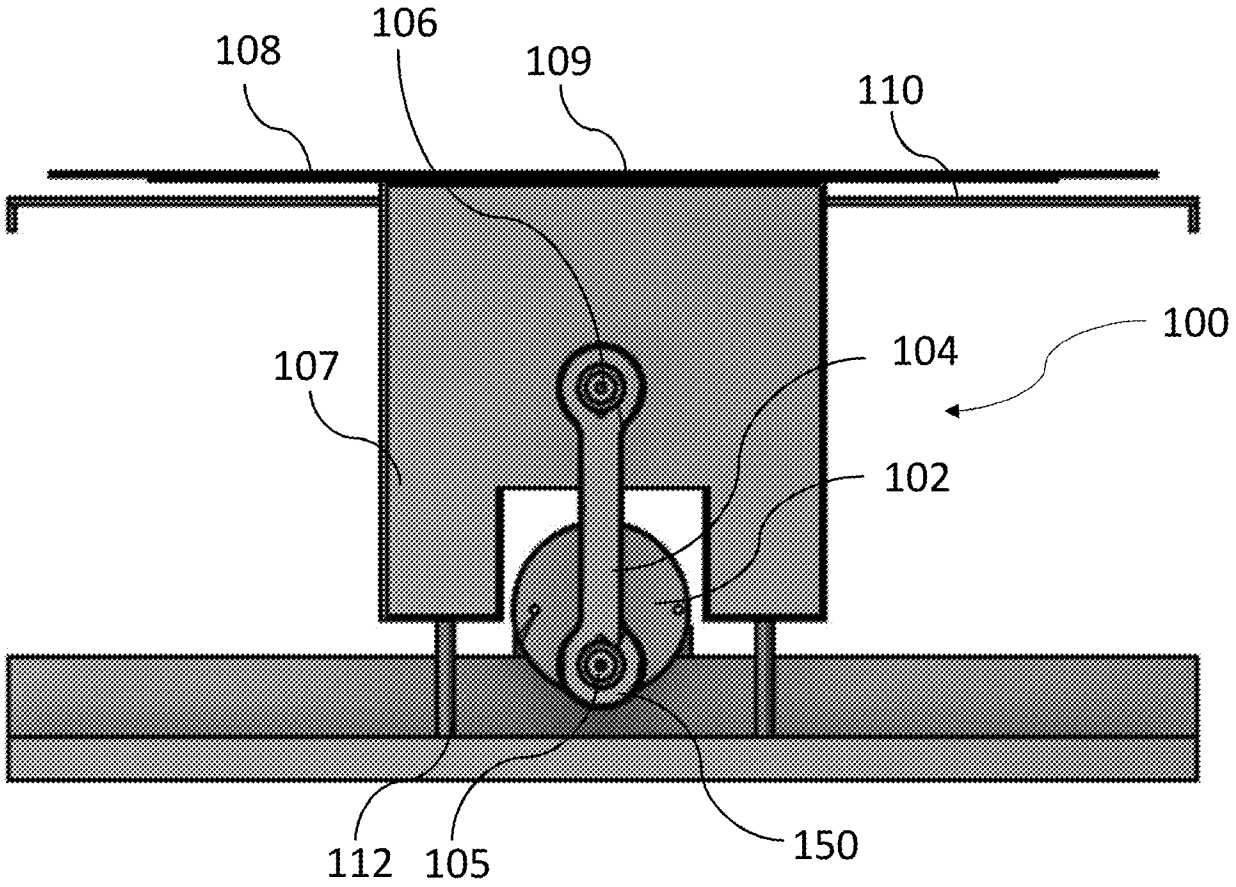
FIG. 1C shows a rear sectional view of the present invention of FIG. 1B.
Figure 1D:
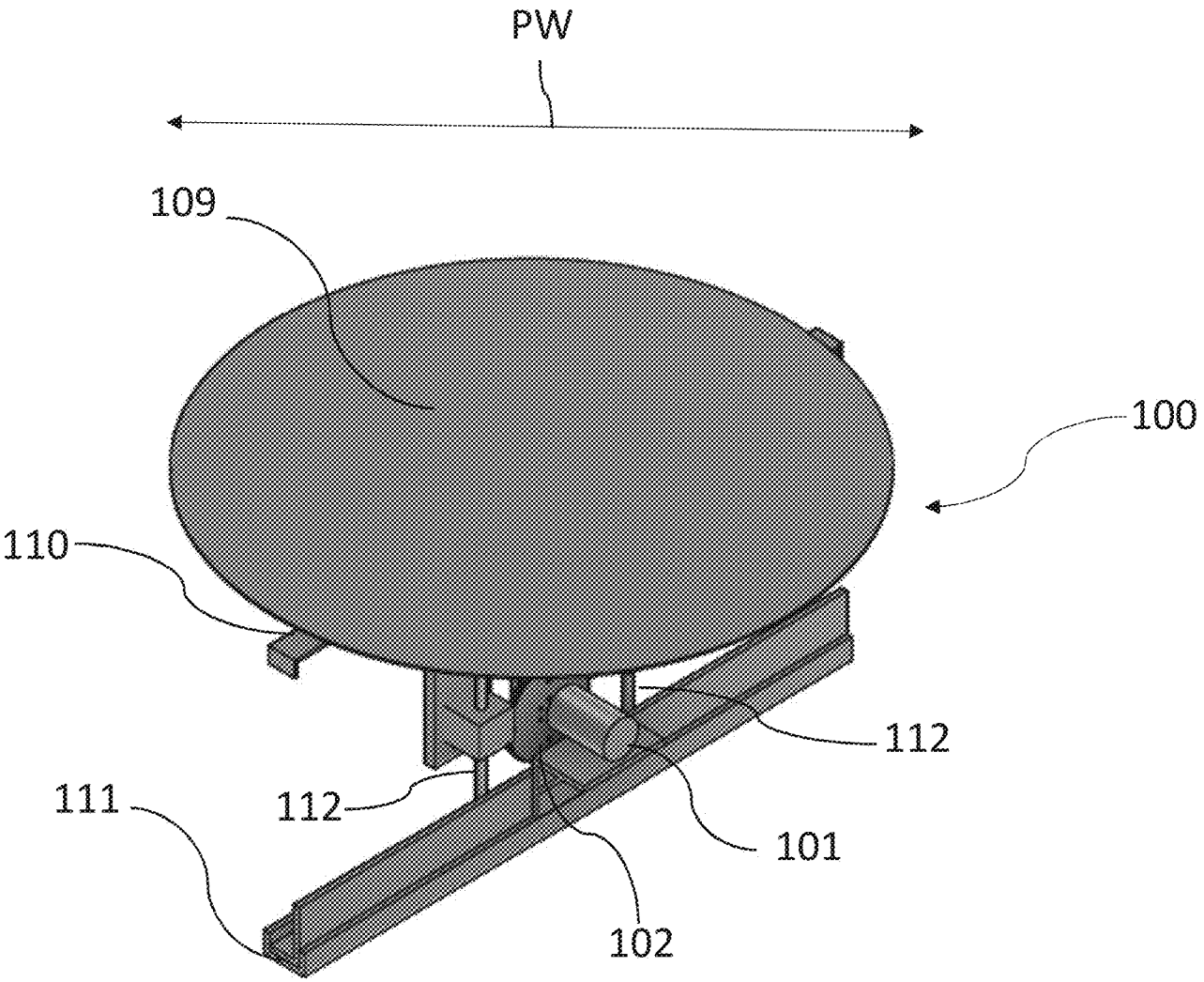
FIG. 1D shows a perspective view of the invention of FIG. 1A, FIG. 1B, and FIG. 1C.

Referring to FIG. 1A and FIG. 1B, a horizontal sectional view of an example embodiment 100 of a dice shaking mechanism 100 according to the first aspect of the present invention are shown. In the example 100 shown, the dice shaking mechanism 100 comprises a driving member 101 which, in the embodiment shown, is a motor. The driving member 101 is oriented along and rotates about a horizontal axis. The driving member 101 is controlled by a controller (not shown).

Extending from the driving member 101 is a drive shaft 120 aligned along the vertical axis. The drive shaft 120 has a rotational axis aligned along the same vertical axis.

Connected to the drive shaft 120 and aligned along a plane perpendicular to that of the drive shaft axis is, in the embodiment shown, a cam wheel 102. The cam wheel 102 is centred on the drive shaft rotational axis. The cam wheel 102 has a 360-degree rotation such that a 0-degree point (or 360-degree) is located vertically above a 180-degree point, both points being along the vertical axis.

At an offset distance from the rotational axis of the drive shaft 102, protruding from the cam wheel 102 is a crankpin 103. The crankpin 103 protrudes from the cam wheel 102 in the opposite direction to the motor driving member 101. The crankpin 103 has a rotational axis (herein referred to as the crankpin axis) aligned parallel to the drive shaft axis directly on the centre of the crankpin 103 where in the offset distance describes the distance between the crankpin axis 103 and the drive shaft axis 120 radially along the cam wheel, the offset in the illustrated embodiment being approximately 2 cm.

A control arm 104 extends vertically from the crankpin 103. A proximate end of the control arm 104 is attached to the crankpin 103 at a first position 105. A distal opposing end of the control arm is located in the illustrated embodiment at a distance from the first position 105, at a second position 106.

A framework is also illustrated in FIG. 1A and FIG. 1B. Affixed to the second position 106 is a frame 107 wherein the frame 107 extends along the vertical axis. The frame 107 has a frame width W aligned along the horizontal axis and a frame length L aligned along the vertical axis, the frame width being W and the frame length being L.

Adjacent to the frame 107 is a platform 108 wherein the platform 108 is aligned along a perpendicular plane to the vertical axis of the driving member 101. The platform 108 comprises a disc with an associated upper platform surface 109. The upper platform surface 109 has an upper platform width of W and the platform 108 has a platform depth of PD, the upper platform width PW being the diameter of the upper platform surface 109 and the platform depth PD being the distance of the platform 108 along the vertical axis.

The dice shaking mechanism 100 further comprises; a limiting mechanism upper component 110 proximate the platform 108 and an opposing limiting mechanism lower component 111, both arranged to form a limiting mechanism. The limiting mechanism upper component 110 and the limiting mechanism lower component 111 are positioned to allow between them an oscillation distance, in certain embodiments the oscillation distance is approximately 10 cm.

Referring to FIG. 1B, a dice shaking mechanism 100 is shown further comprising a guiding mechanism 112. The guiding mechanism 112 is aligned to the driving member 101. The guiding mechanism 112 comprises a pair of rods attached to the frame 107, the pair of rigid rods 114 being attached on either side of the control arm 104. In the illustrated embodiment the rods are rigid. In an alternative embodiment one or more linear rails as an alternative to the rigid rods and bearings may be used.

The dice shaking mechanism 100 further comprises; a sensor 121, a corresponding sensor actuator 122 and an external sensor controller (not shown). The sensor 121 illustration positioned below the frame 107 with the corresponding sensor actuator 122 being positioned on the frame 107 at a point vertically higher along the vertical axis than the sensor in a position that directly opposes the sensor 121.

The sensor is arranged to determine the position of the platform. Other arrangements are envisaged.

Figure 2A:
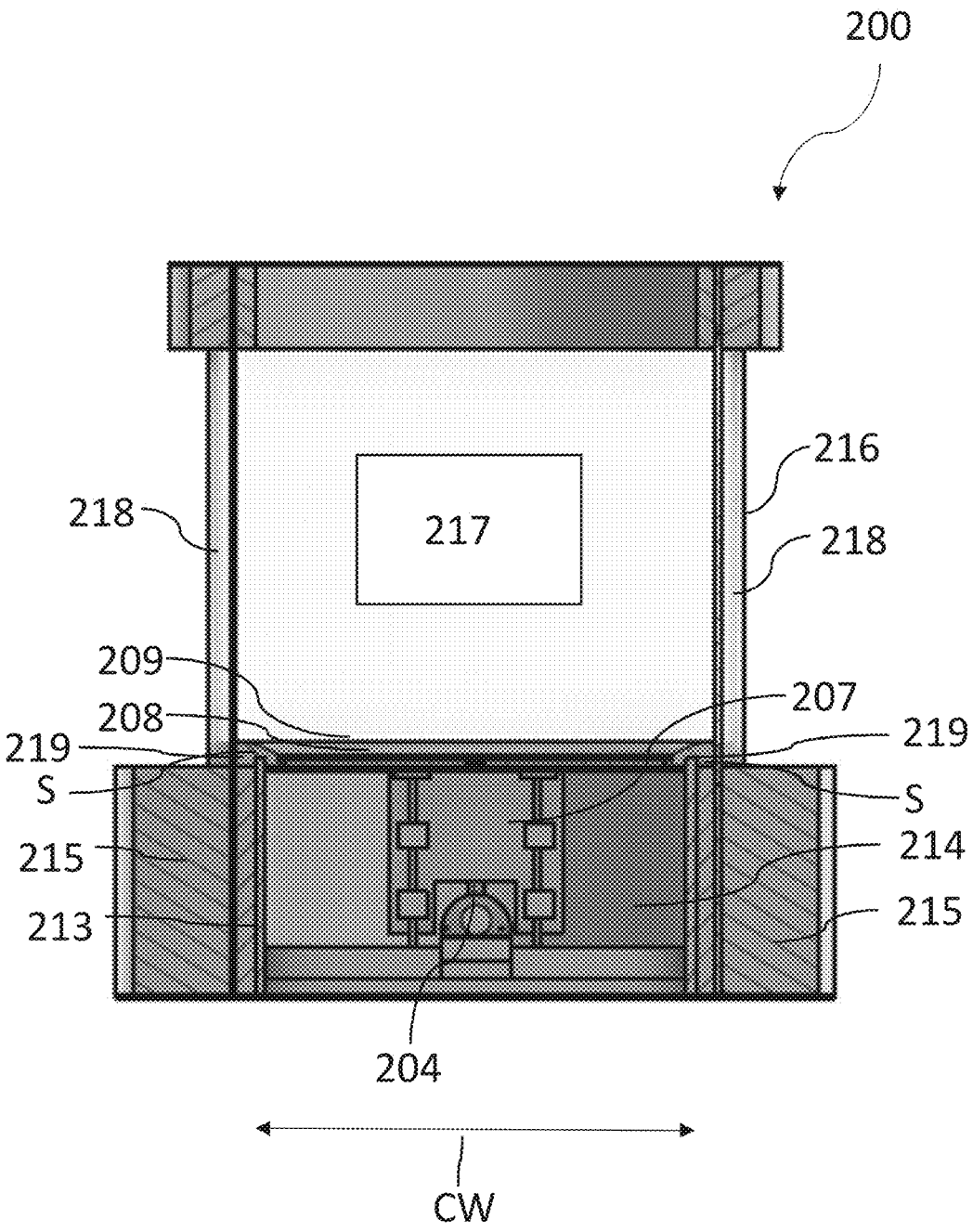
FIG. 2A shows a front sectional view of the present invention including the housing and screening members.

It should be noted that FIG. 2A shows the same embodiment as FIGS. 1A to 1D but with added features described below.

Turning now to FIG. 2A, a front sectional view of the present invention is shown with an embodiment 200 comprising the full dice shaking mechanism 200. In the embodiment 200 shown, the dice shaking mechanism 200 comprises a housing 213 with an associated housing length of HL. The housing 213 is shaped to accommodate the platform 209 with a circular cross section.

The housing 213 further comprises an interior channel 214 with an interior channel width of CW, the interior channel width CW accommodating the circular cross section of the platform 209. The housing 213 further comprises a housing exterior 214. The housing 213 is arranged such that the platform 208 is able to rest atop a section S of the housing exterior. The interior channel 214 is arranged such that it provides a channel through which the frame 207 is able to move along the vertical axis.

The dice shaking mechanism 200 further comprises a screen member 216 having a suitable thickness. The screen member 216 is shaped to have a cross sectional shape matching that of the platform 209, the cross sectional shape being a circle in the illustrated embodiment.

The screen member 216 further comprises a cavity 217 to encompass the platform, with a larger diameter than the platform 208. The difference between the cavity diameter and the platform diameter is lower than the length of a face of a die such that the die is unable to move between edge of the platform 208 and the screen member 216.

Figure 2B:
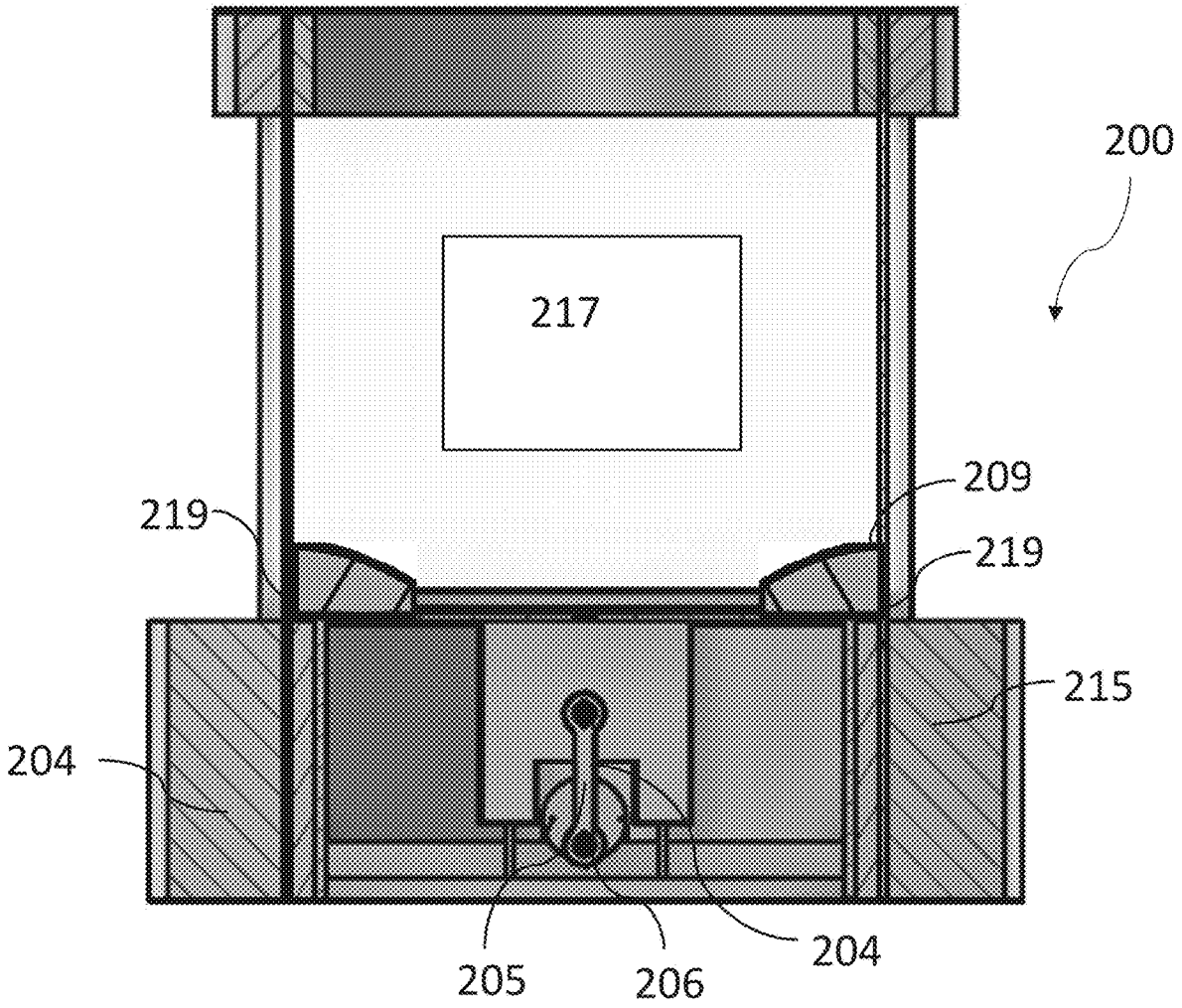
FIG. 2B shows a rear sectional view of the present invention of FIG. 2A.
Figure 2C:
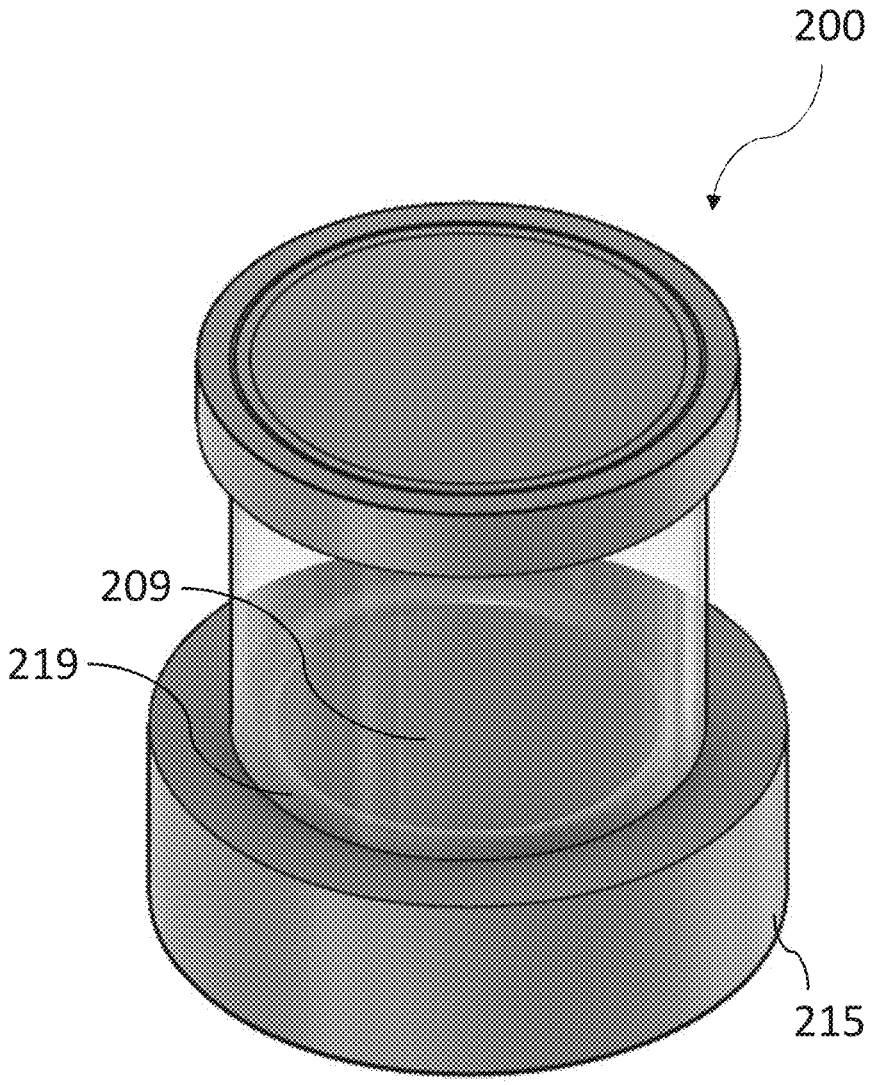
FIG. 2C shows a perspective view of the dice shaking mechanism of FIG. 2A and FIG. 2B.

Referring to FIGS. 2B and 2C, a rear sectional view of the present invention a perspective view of the present invention, the example embodiment 200 being the full dice shaking mechanism 200 as is shown. In the example 200 shown, the dice shaking mechanism 200 further comprises a damping component 219. The damping component 219, being a cushion, is arranged to create a barrier between the platform 209 and screen member 216. The barrier is such that the platform 209 and the housing exterior 215 are prevented from touching.

In use, the driving member 101 is arranged to rotate the drive shaft 120 at a rotational frequency that matches the rotational frequency of the driving member 101. The driving member 101 is controlled by a driving controller (not shown) which allows for the driving member 101 to rotate at a predetermined frequency chosen by the user.

The cam wheel 102 and the drive shaft 120 are arranged such that the rotation of the drive shaft 120 directly translates into the rotation of the cam wheel 102. The arrangement of drive shaft 120, cam wheel 102, crankpin 103 and the control arm 104 allows for the rotational motion of the drive shaft 120 to be converted into reciprocal vertical motion. The reciprocal vertical motion is created by the cam wheel 102 and crankpin 103 arrangement wherein the crankpin is able to rotate around the crankpin axis whilst revolving around the drive shaft axis. This allows the control arm 104 to move linearly along a vertical axis.

The frame 107 is attached in a way such that the linear motion along the vertical axis of the control arm 106 is directly converted into linear motion along the vertical axis for the platform 108. The linear motion of the platform 108 leads to an oscillation distance due to the control arm 104 being indirectly attached to the cam wheel 102 in a manner wherein the first end 150 of the control arm 104 is rotated between the 0-degree and 180-degree points of the cam wheel, thus inducing an oscillation.

The limiting mechanism 110 is oriented so that, at the end of each oscillation, the platform 108 is completely horizontal on the horizontal axis with no deviation from its intended alignment.

The guiding mechanism 112 is arranged such that the linear motion of the frame 107 and the platform 108 are restricted to movement parallel to the vertical axis. As a result, the platform 108 is able to move with all points collinear with the horizontal axis. The platform 108 therefore has no deviation from its intended alignment.

The sensor 121, which in the current embodiment is a light sensor, is positioned to reflect light off the sensor actuator 122, the sensor actuator 122 being attached to the frame 107. The arrangement allows for the external sensor controller to read the sensor 121. Other options, such as a microswitch or proximity sensor may be used. The sensor provides for determination of a location of the platform 209. This also allows for the external sensor controller to calculate the number of oscillations that the dice shaking mechanism 100 has gone through, which, in collaboration with the driving controller, lets the dice shaking mechanism 100 oscillate the correct number of times and to then instigate a final shake if required.

The cavity 217 is configured such that the platform 209 is able to move vertically within the cavity 217 without being restricted by the cavity 217. The cavity length is at least 15 cm, such that the cavity 217 is of an adequate size to allow for a number of dice to shake to a desired dice shaking characteristics.

The screen member 216 comprises a clear material. In other embodiments (not shown) the screen may comprise an opaque metal.

The damping component 219 is arranged such that the platform 209 rests below it when the control arm 204 is in its first position 206 and such that the damping component 219 and the platform 209 are not in contact whilst the platform 209 is travelling towards the second position 205. At rest the platform sits below the top of the cushion (damping component). This minimises the chance that one or more dice are leaning up against the clear cylinder when the shake is finished. There is a final 'shimmy' shake that assists with this too.

It will be appreciated that the above described embodiments are given by way of example only and that various modifications may be made to the described embodiments without departing from the scope of the invention as defined in the appended claims.

The invention claimed is:

1. A dice shaking mechanism comprising: a driving member; a drive shaft connected to the driving member and a cam wheel connected to the drive shaft, the driving member being configured to drive the drive shaft to rotate the cam wheel about a drive shaft axis; a frame configured to support a horizontal platform and to move along a vertical axis of the dice shaking mechanism, wherein the frame comprises a plate arranged to extend in a vertical plane and comprising a first side and a second, opposite, side; a control arm configured to extend in a direction substantially perpendicular to the drive shaft and to control vertical motion of the plate, the control arm comprising: a first end configured to be connected to the cam wheel by a crank pin configured to permit rotation of the cam wheel relative to the control arm; and an opposing second end configured to be connected to the plate; and a first guiding mechanism and a second guiding mechanism, the first guiding mechanism and the second guiding mechanism being arranged to restrict horizontal motion of the horizontal platform of the dice shaking mechanism, wherein the first guiding mechanism and the second guiding mechanism are slidably attached to the first side of the plate, wherein the control arm is rotatably attached to the second, opposite side of the plate such that at least a portion of at least one of the driving member, drive shaft, cam wheel, or crank pin is arranged underneath the plate.

2. The dice shaking mechanism of claim 1, wherein the frame is arranged to reciprocally move between a first position and a second position, each of the first position and the second position located on the vertical axis of the dice shaking mechanism.

3. The dice shaking mechanism of claim 2, wherein the first position is located vertically above the second position.

4. The dice shaking mechanism of claim 2 further comprising:

a limiting mechanism, wherein the limiting mechanism is arranged to restrict movement of the horizontal platform to between the first position and the second position.

5. The dice shaking mechanism of claim 1, wherein the horizontal platform has a platform width; and wherein the frame has a frame width.

6. The dice shaking mechanism of claim 1, wherein the guiding mechanism is a rigid rod and, wherein the frame is attached to the rigid rod.

7. The dice shaking mechanism of claim 1 further comprising:

a sensor; and an actuator.

8. The dice shaking mechanism of claim 7, wherein the actuator is arranged to activate the sensor.

9. The dice shaking mechanism of claim 7, wherein the sensor is positioned opposing the actuator.

10. The dice shaking mechanism of claim 7, wherein the sensor is positioned at a fixed point on the frame or a housing arranged to accommodate the frame.

11. The dice shaking mechanism of claim 7, wherein the actuator is positioned at a fixed point on the frame or a housing arranged to accommodate the frame.

12. The dice shaking mechanism of claim 4, further comprising:

a housing arranged to accommodate:

the frame;

the driving member;

the drive shaft;

the control arm; and the limiting mechanism.

13. The dice shaking mechanism of claim 7, further comprising:

a screen member protruding from the housing.

14. The dice shaking mechanism of claim 13, wherein the screen member is cylindrical.

15. The dice shaking mechanism of claim 2, further comprising:

a damping component to assist with a final location of the dice.

16. The dice shaking mechanism of claim 1, wherein the frame is attached to the second end of the control arm at a position in between the first guiding mechanism and the second guiding mechanism.

* * * * *